US007425176B2

(12) United States Patent
Nelson et al.

(10) Patent No.: US 7,425,176 B2
(45) **Date of Patent: *Sep. 16, 2008**

(54) SIMULATED POKER WITH BONUS WHEEL ADDER

(75) Inventors: Loren Nelson, Reno, NV (US); Dimo D. Ditchev, Reno, NV (US); Russ F. Marsden, Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 366 days.

This patent is subject to a terminal disclaimer.

(21) Appl. No.: 11/223,904

(22) Filed: Sep. 10, 2005

(65) Prior Publication Data

US 2007/0060239 A1 Mar. 15, 2007

(51) Int. Cl.
*A63F 9/24* (2006.01)

(52) U.S. Cl. ..... 463/13

(58) Field of Classification Search ..... 463/13
See application file for complete search history.

(56) References Cited

U.S. PATENT DOCUMENTS 5,489,101 A 2/1996 Moody
5,853,325 A 12/1998 Kadlic
5,971,849 A 10/1999 Falciglia
6,098,985 A 8/2000 Moody
6,110,040 A 8/2000 Sanduski
6,131,907 A 10/2000 Nuciforia
6,132,311 A 10/2000 Williams
6,146,271 A 11/2000 Kadlic
6,149,521 A 11/2000 Sanduski
6,749,500 B1 * 6/2004 Nelson et al. ..... 463/13

* cited by examiner

*Primary Examiner*—Ronald Laneau
*Assistant Examiner*—Emmanuel Omotosho
(74) *Attorney, Agent, or Firm*—Russ F. Marsden; JP Cody

(57) ABSTRACT

A system and method for presenting a player with simulated poker play is disclosed, where the result is actually based on a predetermined outcome. In order to create a realistic play scenario, the present invention never corrects or overrides a player's choices during the play of a hand. Rather, a new solution which incorporates a specially indicated bonus wheel or symbol is used. If a player makes choices while playing a hand that precludes the game machine from creating a needed final value corresponding to a predetermined win amount, a bonus is created to make up any difference. In addition, the way in which the apparent bonus is implemented includes seemingly random bonus awards, allowing both good and poor poker players to receive such bonuses. This further increases the realism of the play.

20 Claims, 2 Drawing Sheets

Game Device
For Modified Poker Play

Method For Using A Bonus Event Matched To A Poker Card To Create Required Outcomes While Maintaining Player Choice In Simulated Poker

SIMULATED POKER WITH BONUS WHEEL ADDER

This application is submitted in the names of inventors Loren Nelson, Dimo D. Ditchev, and Russ F. Marsden, assignors to Sierra Design Group, Inc., a Nevada Corporation.

BACKGROUND OF THE INVENTION

1. Field of the Invention

This invention pertains generally to gaming systems. More particularly, the present invention relates to a method and apparatus for providing the appearance to players of playing an actual poker hand, while playing a game where the actual outcome is predetermined.

2. The Prior Art

Fixed pool games often forming the basis of games used by state and private lotteries. A fixed pool game is one in which a specified amount of money or prizes (the prizes having calculable monetary equivalents) are distributed into a set of individually purchasable units (typically tickets), where each individual unit has a known cost. The tickets include winning and losing tickets. The total amount of prizes, the prize distribution (i.e., the number of prizes at each level), and the total return are known at the game's outset.

The two most common form of tickets are pull tab tickets, called pulltabs, and scratch-off tickets, called scratchers. Pull tab tickets are typically constructed from paper having two layers. The first layer has some type of indication of the purchasers' winnings, if any, and the second layer covers the first. The second layer is typically glued to the first layer around three edges, covering the results. The fourth edge typically has a small tab, allowing the purchaser to grab hold of it. The tab, upon being pulled, pulls the layers apart and reveals the purchasers' winnings, if any. Scratchers use an opaque material that covers portions of the ticket, where the covered portions have the predetermined results on them. The purchaser scrapes off the opaque material, revealing any winnings.

The distribution of the total winnings, coupled with the cost of each individually purchasable unit, is determined by those making up the game. The exact mechanics and mathematics of each game pool depends on the goals of the issuer, including the target play audience (how much to charge per purchasable unit or ticket or play), the desired return on investment, and size of the pool, as well as other considerations known in the art. Once a game is mathematically mapped out, the tickets for the entire game are printed and distributed. The tickets are usually organized into decks with different decks sold to different locations. Players, by purchasing a ticket, are buying one individually purchasable unit from the overall ticket or game event pool.

This is referred to as a fixed-pool lottery, meaning there is a fixed pool of tickets (or results) having a predetermined number of winners and losers, and a purchaser takes a chance on getting a winning result by entering the "lottery", meaning taking the chance they will by a winning ticket from the pool.

To make the results more interesting to a player, fixed-pool lottery based games recently been displayed on video-based lottery machines. One particular representation shows a poker hand, where the video game attempts to mimic actual poker play. The player bets a certain amount to play the game. This corresponds to an individually purchasable unit or ticket. The game will typically get a game result using a random drawing from a pool of game results located on a central server. The result is sent back to the game machine. The game machine then attempts to represents the results as a poker game.

Up to the present time, game machines using fixed-pool lotteries which have attempted to represent the predetermined winning amount by mimicking poker play have had significant limitations. In particular, the prior art machines would present the player with a 5 cards (mimicking a hand), selected to allow the already-determined win amount to be shown from the cards displayed. The player would indicate which cards to hold and which to discarded. If a player is not a good poker player, or is going for long odds, if is likely they will discard cards that were needed to make up the predetermined win amount.

As an example, assume the predetermined game result required the player to end up with a full house. The player's initial hand shows two pair. If the player discards one from each pair, leaving three unrelated cards, a full house cannot be created with the new draw. The prior art game overrode the player's hold choices and discarded the "correct" cards, resulting in a new hand having a full house.

The action of overriding a player's choices completely ruins the illusion of playing poker. There is a need to have a game, based on the use of fixed-pool lotteries, that better mimics true poker play from a player's perspective.

BRIEF DESCRIPTION

Disclosed is a new method and apparatus to allow realistic simulated poker play while actually playing a fixed-pool game. Unlike previous games which overrode or restricted a player's choice of play with respect to some cards in an initial hand, the present invention allows the player to make any play consistent with the rules of any simulated poker game being played. In one embodiment using simulated poker based on five card draw, the allowable interactions are made up of choosing which cards to hold and which to discard.

Fixed-pool systems provide a game result to a gaming machine when game play is initiated by a player. The game machine then maps the predetermined result into a simulated poker game. The first action is to present the player with an initial hand, selected in accordance with the predetermined win amount. The player selects which cards to hold. The remaining cards are replace with other cards, again selected to generate the predetermined win amount. If a player makes poor decisions, or tries to play a long shot (as if they were playing real poker), the result after the hold can be a set of cards that no longer allows the game to represent the predetermined winning amount. Use is then made of a special graphic illustration to show a separate "win" event to the player. One embodiment is a poker bonus wheel. Other shapes may be used. The poker bonus wheel is a circular illustration of a wheel on the video display having win or bonus amounts displayable in segments of the wheel. Alternatively, the segments may display card equivalents (a suit and a value). When invoked, a spinning arrow or colors indicating randomized or circular movements between the segments is shown to the player. When the selection mechanism stops (an arrow stops spinning, changing colors become steady, etc.), one segment of the wheel is visually indicated. The visually indicated segment becomes associated with a pre-designated match card, with the pair having a desired (predetermined) value. Alternatively, both one segment and one card from the player's hand (an "in-hand" card) are visually associated when a selection mechanism stops for both. The associated pair will indicate a bonus amount directly, by displaying a value, or indirectly, by showing an association between the card and segment that is then mapped to an amount. In one embodiment, the segments of the wheel are associated with card suits and values. "Associated" is explained further below, but means there is one of player's in-hand cards that is visually connected to the match card. If the symbol and a card in the player's hand are shown as matching (in one preferred embodiment the same suit and value) a bonus award is displayed.

When a player plays a simulated poker game and picks cards to hold such that a predetermined win amount cannot be created, the poker bonus wheel is used to make up the difference. The poker wheel will be animated to show a "bonus win" that, when added to the amount won during simulated play, equals the predetermined win amount.

This appears to the player as an extra bonus to the game, rather than being a correction to poor play by the player. This creates the illusion to a player that simulated poker is real poker.

DETAILED DESCRIPTION OF EXEMPLAR EMBODIMENTS

Persons of ordinary skill in the art will realize that the following description of the present invention is illustrative only and not in any way limiting. Other embodiments of the invention will readily suggest themselves to such skilled persons having the benefit of this disclosure.

Figure 1:
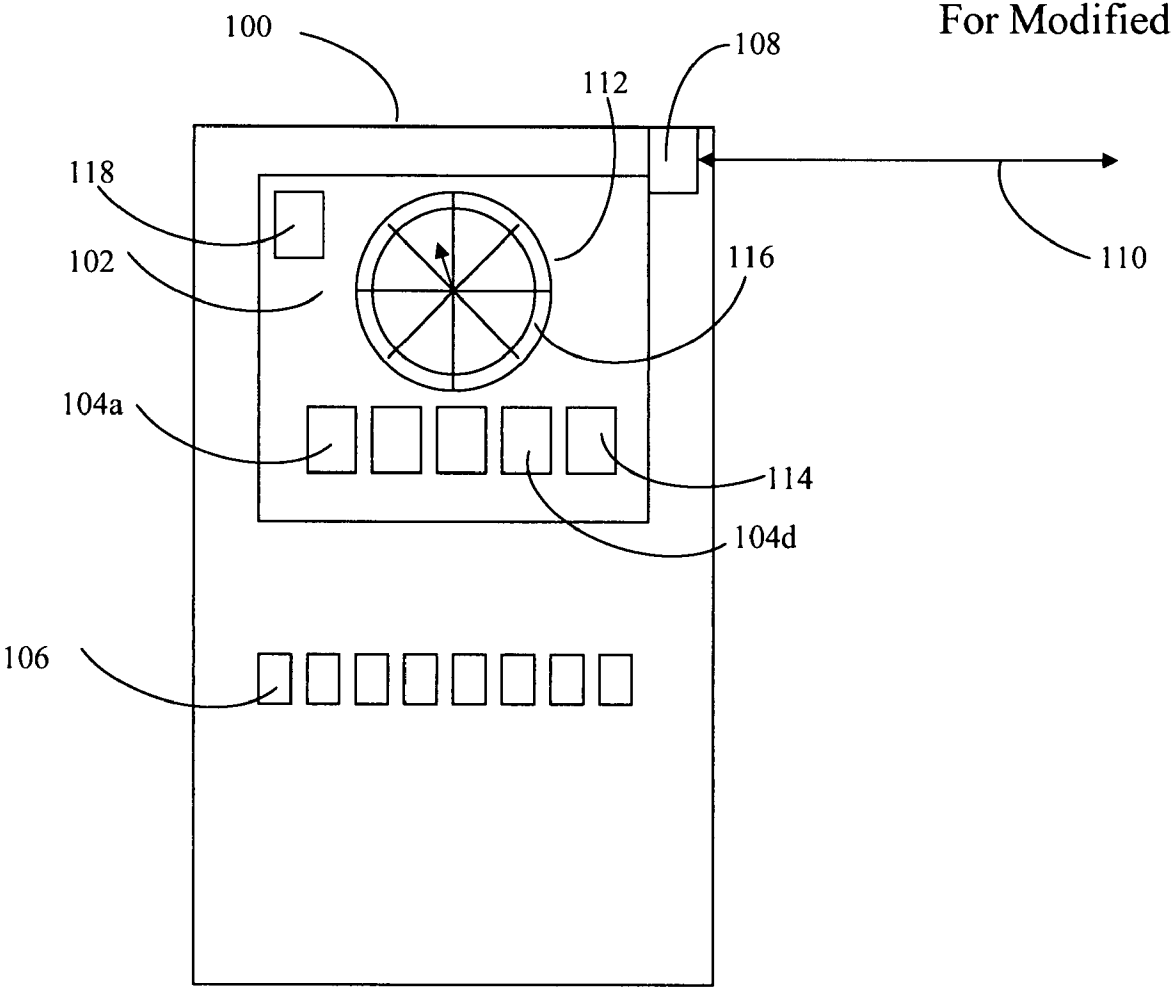
FIG. 1 is a functional block diagram of an example game device in accordance with the present invention.
Figure 2:
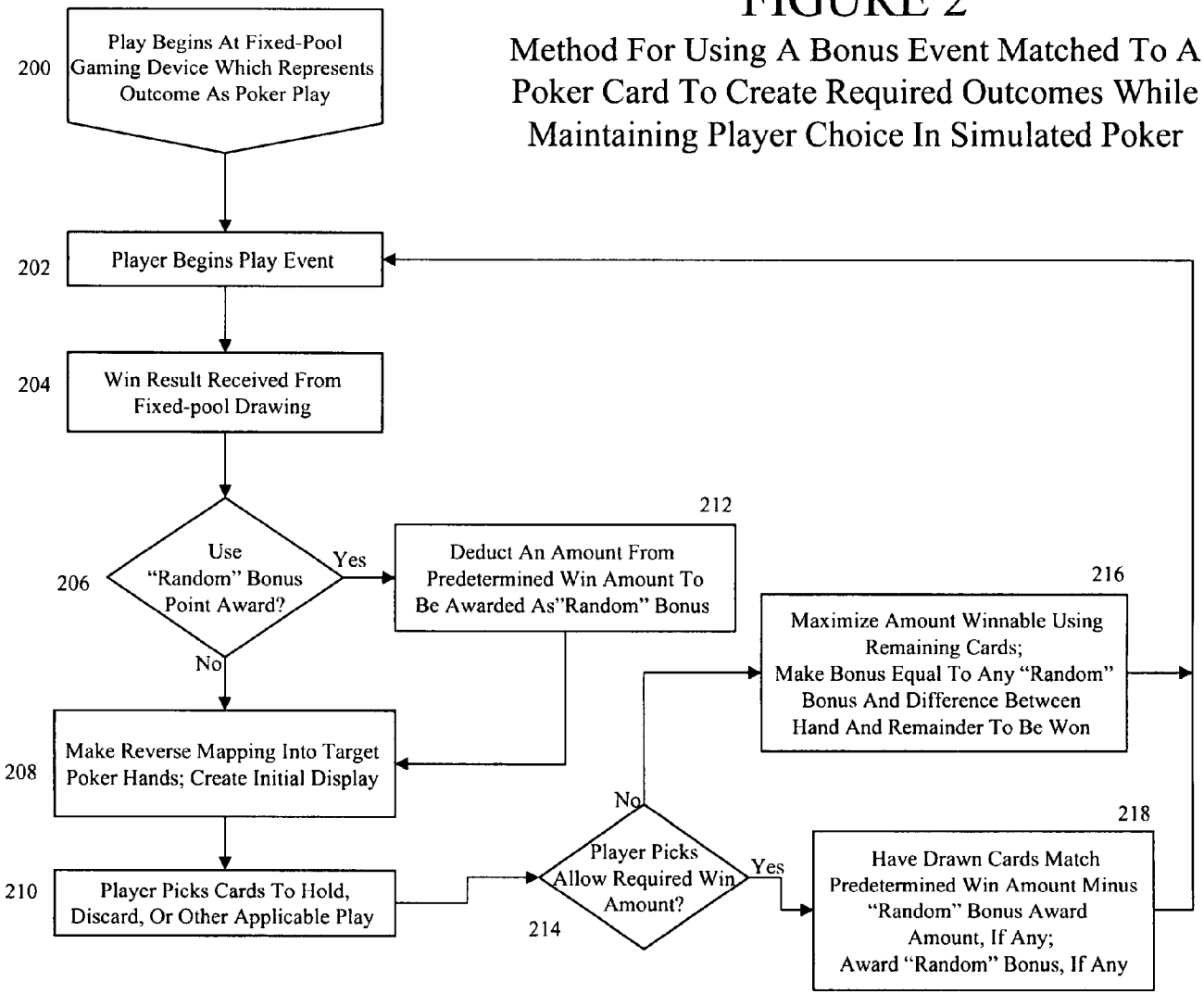
FIG. 2 is a flow diagram illustrating simulated game play in accordance with the present invention.

Referring to the drawings, for illustrative purposes the present invention is shown embodied in FIGS. 1 and 2. It will be appreciated that the apparatus may vary as to configuration and as to details of the parts, and that the method may vary as to details, partitioning, and the order of the acts, without departing from the inventive concepts disclosed herein.

FIG. 1 shows a game device showing one embodiment. The game device has a cabinet 100 enclosing a video display 102 and a set of standard game play buttons shown generally as buttons 106. Any input devices may be used, including but not limited to joy sticks, touch screens, etc. The game device also comprises the internal hardware and software needed for gaming devices, including at least one processor, dynamic memory, non-volatile memory, system support circuitry configured to allow an embedded operating system to run on the processor, and I/O connections which include interfaces to the various player interfaces including play buttons 106 and video 102 output. Also included is an interface to an external network connection shown here as SMIB (slot machine interface board) 108 which interfaces to network 110. There may be Ethernet ports, wireless connections, or any other operable network connection allowing the gaming machine to be in operable communication with a server. Also included is the software needed to implement the specific game. The internals are not illustrated.

Also shown is simulated poker bonus wheel 112. Part of each segment in wheel 112 is area 116 which will show either a bonus value or a suit and card rank (ace through king). Using the simulated poker bonus wheel enables very realistic simulated poker play. In one embodiment where the wheel segments have either a suit and card rank or a bonus value, a the simulated bonus poker wheel segment that is matched or associated with an in-hand card will be referred to as a "match segment." "In-hand" refers to the cards that comprise one poker hand currently in use by a player (note: there may be a plurality of poker games running at once, with one embodiment allowing a player to select how many hands they wish to play at a time). The actual number of cards in-hand varies depending on the type of poker being played or used. Illustrated is draw poker, having five cards in-hand, shown as cards 104*a* through 104*d* and match card 114.

Match segment 116 is indicated in some way after a wheel indicia which had shown apparent motion comes to a halt at the completion of the player's play. The wheel indicia includes but is not limited to a pointer or moving or apparently moving lights which can visually indicate a segment. The player's play includes the player being shown a hand, making any hold decisions, and the discarded cards replaced. This applies to any other sequence of actions corresponding to any poker variant. The apparent motion of pointers, colors, or other visual method of picking segments in wheel 112 may start anytime the game designer thinks best; before, during, or after a player has finished a game. Simultaneously with, or shortly after, game play is finished one segment of wheel 112 is visually distinguished from the others. In the illustrated embodiment, the match segment is associated with card 114. If the match segment and card are a match, a bonus amount is awarded and displayed in bonus window 118. The bonus amount is added to the player's overall game credits or score.

As used in this disclosure, "match" is defined to mean that symbols in a visually indicated wheel segment and a match card have one of: the same suit and value; the same suit; or, the same value (rank). In other embodiments, match cards and wheel segments may also be "related." "Related" is defined to mean any suit/rank combination related by explicit rules of the game other than suit and rank. An example of "related" symbols is having the visually highlighted segment be twice the value of the in-hand card, such as the match segment being a ten of diamonds and the in-hand card to which it is associated being a five of diamonds. Each particular game implementation will make clear which cards match or are related.

Although one embodiment uses five card draw as shown in FIG. 1, any poker variant may be used including but not limited to 5 and 7 card stud, Texas Hold'em, the various three-card and more in-hand card games found in some poker games, and any number of multi-line and multi-hand poker variations. In multi-hand embodiments, each in-hand card set (representing one hand being played) will have one in-hand card associable with at least one wheel segment. There must be at least one wheel segment associated with one in-hand card in each playable hand, while a single wheel segment may be associated with more than one in-hand card.

Apparent skill embodiments may be added in many ways. In one embodiment, a player will touch a "stop" indicator on the gaming machine (button, touch screen, or other input) in an attempt to stop the visually changing segment indicator (indicia) at a particular location. The visually changing indicia may be a pointer moving inside the wheel, lights around the periphery of the wheel, lights jumping between segments, or other visually changing segment indicator. Although the gaming machine logic is actually controlling the indicia, the logic will be programmed to show the indicia stops as soon as possible after the player touches the stop indicator. Of course, the game logic will have the indicia stop at the segment needed for the required (already known) payout amount. This is called apparent skill because to the player, it appears their action of hitting a stop indicator actually causes the segment indicator to stop near a desired location.

In a further embodiment, a visually identifiable and dynamic link is shown between a match card and various wheel segments. The link is shown by bright same-color borders around the match card and an on-going sequence of wheel segments, preferably also using increased intensity. With multiple hands being played simultaneously, corresponding match segments and in-hand cards may be visually indicated using different colored borders for each pair, or having each pair show an intensified color-cued and color-hued image. If the borders or other color-based highlights are made to appear to "move" down the line of in-hand cards, an apparent skill game may be implemented by allowing the player to hit a stop button when the currently highlighted card matches a desirable match segment (shown with the same hue).

Referring now to FIG. 2 and starting at box 200, a player begins play at a game device where the underlying game results are generated from a fixed-pool lottery. Moving to box 202, the player initiates a game play event. A game play event is any action or actions (such as choosing bet amounts and then hitting a "play" button) by a player that results in game play be started. Upon the occurrence of a game initiation event, box 202 is left and box 204 entered.

The actions corresponding to box 204 are the game device communicating to a backend machine on which an applicable fixed-pool lottery game is being run. The game device signals the backend for a game result, and a result is sent back to the game device. The game device now knows the amount of winnings a player must be awarded by the end of the play sequence (hand) about to be started. Note that although game results ultimately come from a pool, implementations will vary greatly. One implementation may have a subset of game results provided to interim servers or to the game machine, with the subsets of game results being exhausted before further results are requested. All variations are fully contemplated herein.

Continuing now with diamond 206, a decision is made on having a "random" bonus prize appear to the player.

The word random is in quotes as the actual implementation of this event may be entirely calculated or may be partially based on a random event. The random aspect being referred to is from the player's perspective. To make the bonus awards appear to be a true bonus rather than as a crutch for poor player choices, it is preferred to make bonus awards even when a player makes all the correct plays all the time. Otherwise, a regular player would notice that by making correct choices they never win a bonus, whereas the poo-poo poker player next to them gets bonuses on a regular basis. To prevent this perception, a portion of the total game credit awards (or other form of winnings) to be awarded to the player must be given to as a bonus as well as a result of the apparent poker play. To accomplish this some portion of the net amount to be awarded is set aside to be awarded as a bonus award, awarded even if the player plays perfectly. The result is that good poker players will see a regular occurrence of bonus awards as well as poor players. This prevents the bonus match from appearing as a "poor play fix" and making the predetermined nature of the game obvious.

Continuing with diamond 206 and based on an algorithm chosen by the game implementers, the decision is made to take a portion of the predetermined amount from the total and use it as a bonus award or not. Note that if there are no winnings associated with this play, the answer is clearly "No"! If there is a winning associated with this play, and if the answer is "Yes" (i.e., a bonus-portion of the predetermined amount is to be set aside), then the "yes" exit is taken to box 212.

The actions corresponding to box 212 include the actions of first determining the amount to used for the bonus award, and deducting that amount from total amount to be awarded. It is possible that a portion of the predetermined amount may include the entire amount. This will be part of the decision made in box 212. In such a case the entire winnings will be presented to the player in the form of a bonus award. In all cases, the amount to be used as a bonus award is deducted from the amount to be used in determining the outcome of the impending poker play. Box 212 is left and box 208 is entered.

Returning briefly to diamond 206, if there is to be no bonus award portion of the winnings, the "No" exit is taken to box 208.

Continuing with box 208, the game device makes a reverse mapping of the award points to be given during game play into applicable poker hands, in accordance with the variant of poker being played. The initial poker hand is chosen so that it can result in a desired hand, with the right player choices. Box 208 is left and box 210 entered, where the player interacts with the game in a manner consistent with the type of poker being played. In one preferred embodiment this is five card draw, where a player indicates which cards they will hold. Box 210 is left and diamond 214 entered.

The decision in diamond 214 is based on the actions the player took. If the player chose the correct actions thereby allowing the game device to create the final hand needed (corresponding to the pre-selected award amount minus any bonus amount), then the "Yes" exit would be taken to box 218. Otherwise the "No" exit would be taken to box 216.

Proceeding from diamond 214 along the path that corresponds to a correct play choice, the "Yes" exit is taken to box 218.

The actions corresponding to box 218 are to show the final hand (not changing any of the choices the player made), corresponding to the total award amount minus any bonus award amount (this may be 0). The player has "won" an amount corresponding to the final set of in-hand cards. The game device now animates and fixedly reveals the match segment associated with an in-hand card to produce the needed results. If the match segment and its associated card are a match or related as defined for this game, then the player is awarded bonus points as shown on the gaming machine in a display. The amount won for box 218 will only be the random bonus award from box 212, if any. Adding the bonus award winnings (amounts) and the in-hand card set winnings (amounts) always equals the predetermined winnings (amounts) the game device received from a backend machine at the start of play.

Proceeding from box 218, the game is now ready to play again and the process continues at box 202 when the player initiates a game play event. The loop will continue as long as the player is using the game device.

Returning to diamond 214, if the player made bad card and/or play choices so that a hand comprising a set of cards needed to show a win of the amount to be awarded can no longer be created, the "No" exit is taken to box 216. A quick example of such a situation is a five card draw poker machine where the amount to be awarded to a player corresponds to a hand having a full-house. The initial cards shown to the player are two pairs and a singleton. For some reason (like trying to fill in a flush), the player discards one from each pair. A full house can no longer be made from the remaining cards in the players' hand. Diamond 214 is left and box 216 entered.

The actions corresponding to box 216 include having the game device create a hand having some portion of the amount that was to have been awarded, where it is possible the portion may be unable to make any award depending on what the player did. The balance still due the player is then added to the previously deducted bonus amount and the sum awarded through the use of the match segment. This is done by having a segment be associated with, and also be a match to (or related to) an in-hand card. The player has now won the total amount that was to be have won in this hand through the use of both the hand itself and the bonus award associated with the match card. In no case has the player's card choices been altered. Box 216 is left and the process will continue with box 202 when a game initiation event occurs.

As used in this disclosure, a "play sequence" means a sequence of events starting after the game device has a known, predetermined amount of winnings (including 0 winnings) to be displayed, credited, and/or otherwise awarded to a player upon the termination of the sequence and the game device has presented the player with an initial set of cards, through any and all player interactions, to the state of the game device where the aforementioned predetermined amount of winnings has a visible display showing the player has been awarded or otherwise given the predetermined mount of winnings.

"Player interactions" or "player interaction" includes any and all player use of the game that are in accordance with the general type of poker being simulated coupled with the rules of the particular implementation. In one embodiment, there is a five card hand shown to the player, and the player interaction consists of choosing which cards to hold. In this embodiment the player may hold from 0 to 5 cards. The player may change their mind as much as they prefer until the player indicates to the game device the player is ready for the replacement cards. This is usually accomplished by touching a "deal" or "play" button. Once the play button is touched, the game device no longer accepts player input for card choice, and the play sequence finishes.

The word winnings, award amount, or bonus is used to mean any form or type of winnable item found on any type of game device. This may be game credits, award credits, savable game states corresponding to some form of value associated with game play, cash, vouchers, tickets, tokens, fixed-value prizes, and any other form of winnable unit that may be used in a game device. A "winning amount" or "winnings amount" is used to mean some number of the winnable units.

The poker game and poker bonus wheel and segments may readily be implemented using only video representations, physical representations with pointers (typically controlled by stepper motors) and/or lights, or a mix of video and physical implementations. Other embodiments will come to the mind of those having skill in the art coupled with the benefit of the present disclosure. All such variations and embodiments are contemplated herein, including technologies not currently commercially viable such as 3-D laser displays, etc.

The presented flow diagram is to be understood by a person of ordinary skill in the art having the benefit of the present disclosure as steps which can vary as to order, content, allocation of resources between steps, times repeated, and similar variations while staying fully within the inventive concepts disclosed herein.

Accordingly, disclosed herein is a gaming machine system and method for providing the appearance of true poker play, when the game is in fact representing predetermined outcomes based on drawings from an existing pool of game results. This is accomplished with the use of a poker bonus wheel made up of match segments, where a match segment and its associated bonus is matched to a card in a player's hand to allow awarding of the full amount due for this game. This can be accomplished no matter how badly a player plays, and will not require overriding any player choices.

Although the description above contains certain specificity, the described embodiments should not be construed as indicating the scope claimed; the descriptions given are an illustration of embodiments. The scope is determined by the appended claims and their legal equivalents.

What is claimed is:

1. A method for simulating poker play on a game device, where the type of poker to be simulated is known at the start of a play sequence and where said type of poker has a defined set of player interactions, and where a predetermined winning amount having a 0 or greater value is associated with the play sequence and is known at the start of the play sequence, and where the game device provides a wheel comprising segments individually associable with an in-hand card, the method comprising:

(a) showing an initial set of cards comprising an initial hand in accordance with said type of poker game and in accordance with said predetermined winning amount;

(b) allowing player interaction with said game device where said player interactions are in accordance with said type of poker and its defined player interactions;

(c) having said game device not unilaterally change any of said allowed player interactions;

(d) determining a final set of cards in accordance with said initial set of cards and said player interactions, and further having a value less than or equal to said predetermined winning amount, said value being a final hand amount;

(e) calculating a difference between said predetermined winning amount and said final hand amount, said difference being a bonus amount;

(f) making said determined final set of cards visible;

(g) indicating one of said segments; and (h) associating said segment and said in-hand card where said associating comprises one of: matching said segment and said in-hand card and showing a value comprising said bonus amount if said bonus amount is not 0; or, not matching said segment and said in-hand card if said bonus amount is 0.

2. The method of claim 1 further comprising associating said segment with said in-hand card, where said segment and said in-hand card are not matched and where a bonus is one of: not shown; or, shown as having no value, if said bonus amount is 0.

3. The method of claim 1 where said poker type is five card draw, and said defined player interactions comprise holding one of: any, some, or none of said initial set of cards.

4. The method of claim 1 where said associating said segment with said in-hand card further comprises having said segment having associated visually moving indicia on a screen in a visible manner where said indicia is stopped in a manner that visually identifies said segment.

5. The method of claim 4 where said associating said segment with said in-hand card further comprises enabling the reception of a stop request after said segment's indicia is moving and before said indicia stops moving, and where said moving indicia further stops moving as quickly as possible after said game device receives said stop request and in a manner visually associated said segment with said in-hand card consistent with said bonus winning amount.

6. The method of claim 1 where associating said segment with said in-hand card further comprises creating a same visual change to both said segment and said in-hand card where said visual change comprising one of: a color-based change; an intensity-based change; a hue-based change; or, a combination of color, hue and intensity change.

7. The method of claim 6 where said associating said segment with said in-hand card further comprises enabling reception of a stop request after said visual change is shown with said segment while a substantially similar visual change is being applied to said in-hand cards, one at a time and moving from either from one segment to another or from one in-hand card to another, before said visual changes stop, and where said visual changes stop as quickly as possible after said game device receives said stop request and in a manner where said visually changed in-hand card and said same visually changed segment are consistent with said bonus winning amount.

8. The method of claim 1 further comprising choosing, before said simulated poker game play starts, one of a plurality of choices, said choices comprising different poker games.

9. The method of claim 1 further comprising choosing, before said simulated poker game play starts, a number of simultaneous poker hands to play.

10. A method for simulating poker play on a game device, where a type of poker to be simulated is known at the start of a play sequence and where said type of poker has a defined set of player interactions, and where a predetermined winning amount having a 0 or greater value is associated with the play sequence and is known at the start of the play sequence, and where the game device provides a wheel comprising segments associable with an in-hand card, the method comprising:

(a) using at least a portion of said predetermined winning amount for an initial bonus winning amount;

(b) calculating a target winning amount based on a difference between said predetermined winning amount and said initial bonus winning amount;

(c) showing an initial set of cards comprising an initial hand in accordance with said type of poker game and in accordance with said target winning amount;

(d) allowing player interaction with said game device where said player interactions are in accordance with said type of poker and its defined player interactions;

(e) having said game device not unilaterally change any of said allowed player interactions;

(f) determining a final set of cards in accordance with said initial set of cards and said player interactions, and further having a value less than or equal to said target winning amount, said value being a final hand amount;

(g) calculating a difference between said target winning amount and said final hand amount;

(h) making said determined final hand visible; and, (i) associating one of said segments with said in-hand card, where said segment and said in-hand card are matching and have a value assigned comprising said difference between said target winning amount and said final hand amount and adding to said difference to said initial bonus award amount.

11. The method of claim 10 further comprising associating said segment with said in-hand card, where said segment and said in-hand card are not matched, where a total bonus winning amount comprising said difference between said target winning amount and said final hand winning amount and further comprising adding to said difference said initial award bonus amount, if said total bonus winning amount is 0.

12. The method of claim 10 where said poker type is five card draw, and said defined player interactions comprise holding one of: any, some, or none of said initial set of cards.

13. The method of claim 10 where said associating said segment with said in-hand card further comprises moving an indicia around said wheel and stopping said indicia in a manner that visually identifies said segment.

14. The method of claim 13 where said associating said segment with said in-hand card further comprises enabling the reception of a stop request while said indicia is moving, where said indicia stops moving as quickly as possible after said game device detects a stop request in a manner that visually indicates said segment.

15. The method of claim 10 where associating said segment with said in-hand card further comprises creating a same visual change both said segment and said in-hand card where said visual change comprising one of: a color-based change; an intensity-based change; a hue-based change; or, a combination of color, hue and intensity change.

16. The method of claim 15 where said associating said segment with said in-hand card further comprises receiving a stop request after said visual change is shown on said segment and while a similar visual change is being applied to said in-hand cards one at a time and moving from one in-hand card to another, before said visual changes stop, and further where said visual changes stop as quickly as possible after said game device receives said stop request such that said visually changed in-hand card that matches said visually changes segment are consistent with said bonus winning amount.

17. The method of claim 10 further comprising choosing, before said simulated poker game play starts, one poker game from a plurality of poker games.

18. The method of claim 10 further comprising choosing, before said simulated poker game play starts, a number of simultaneous poker hands to play.

19. A game device having at least one poker style game operably disposed therein and having a connection configured to be operable with at least one source useable to establish a winning amount having a 0 or greater value, comprising:

a display;

a wheel comprised of segments visible on said display and under operable control of said poker style game;

at least one set of in-hand card images displayable on said display and under operable control of said poker style game;

where said poker style game is further configured to enable completion of a play sequence having a first value and further configured to associate one of said segments with one of said in-hand cards images after said play sequence is completed and associated a second value with said associated segment and in-hand card image such that said first value and said second value taken together equal said winning amount.

20. The game device of claim 19 where said at least one poker style game comprises a plurality of poker style games and is enabled to receive an indication of which of said plurality of poker style games to play.

* * * * *